US005984756A

United States Patent [19]

Krog

[11] Patent Number: 5,984,756

[45] **Date of Patent: *Nov. 16, 1999**

[54] TOY CONSTRUCTION SYSTEM

[75] Inventor: Ricco Reinholdt Krog, Vejen, Denmark

[73] Assignee: INTERLEGO AG, Baar, Switzerland

[ * ] Notice: This patent is subject to a terminal disclaimer.

[21] Appl. No.: 09/040,720

[22] Filed: Mar. 18, 1998

[51] Int. Cl.[6] ..... A63H 33/08

[52] U.S. Cl. ..... 446/120; 446/127

[58] Field of Search ..... 446/116, 120, 446/121, 122, 124, 127; 403/4, 310, 360, 375

[56] References Cited

U.S. PATENT DOCUMENTS 4,738,648 4/1988 Berndt ..... 446/120
5,061,219 10/1991 Glickman ..... 446/120
5,518,434 5/1996 Ziegler ..... 446/120
5,704,186 1/1998 Alcalay et al. ..... 446/124
5,823,843 10/1998 Pohlman ..... 446/120

*Primary Examiner*—Robert A. Hafer
*Assistant Examiner*—Jeffrey D. Carlson
*Attorney, Agent, or Firm*—Kane, Dalsimer, Sullivan, Kurucz, Levy, Eisele and Richard, LLP

[57] ABSTRACT

The invention relates to a toy construction system comprising building elements of a first type having a pair of opposed walls that define a space between said opposed walls, wherein the space has, at the free edges of the opposed walls, an open end and two opposed open sides, and wherein those sides of the walls that face towards the space are provided with protrusions, and building elements of a second type having a coupling head that may, by snap-fit with the protrusions, be received and releasably secured in the space between the walls on a building element of the first type. The toy construction system is characterised in that the protrusions are situated at the free edges of the walls.

5 Claims, 3 Drawing Sheets

TOY CONSTRUCTION SYSTEM

BACKGROUND OF THE INVENTION

1. Field of the Invention

The invention relates to a toy construction system comprising two types of building elements. Building elements of the first type have a pair of opposed walls that define a space, wherein the space has, at free edges of the opposed walls, an open end and an open side, and wherein the walls have, on the sides facing the space, protruding ribs. Building elements of the second type have a coupling head that may, by a snap-fit effect with protruding ribs, be received and releasably secured in the space between the walls on a building element of the first type.

In such toy construction system, toy building elements of the one type can be structural elements, whereas building elements of the other of said types can be connectors for connecting two or more structural elements. The connectors may have relatively small dimensions whereas the structural elements have relatively large dimensions. The structural elements may be straight or arched bars of different lengths, or they may define or expand large or small surfaces that are used for imparting its structure to the construction built. Such toy construction system allows for easy and expedient building of large constructions.

2. Description of the Related Art

U.S. Pat. No. 5,061,219 teaches a toy construction system of the type described herein, where a first building element has a pair of opposed, parallel arms or walls that define a space that will, by snap-fit engagement, receive and secure a coupling head on one end of another, bar-shaped building element. In the sides that face towards the space each of the walls is provided with protruding ribs of which two ribs extend longitudinally to said arms, and a single rib extends transversally to the arms. The transversal ribs are arranged at a distance from the free ends of the arms and thereby they divide the space between said arms into an inner coupling chamber and an outer coupling chamber. Assembly and separation can only be accomplished along one definite direction whereas, in practice, assembly and separation are impossible along a direction transversally to said one direction, since the transversal ribs prevent this. This is due to the fact that, measured from the inner end portions of the arms to the transversal ribs, the lever arms are very short, and if said arms are to be able to open sufficiently for the coupling head to be able to pass the transversal ribs, i.e. from the internal coupling chamber to the external coupling chamber or vice versa, unrealistically much force is to be applied with the ensuing risk of the arms breaking.

BRIEF SUMMARY OF THE INVENTION

Thus, it is desired to provide a toy construction system of the type described herein, wherein assembly and separation of building elements can be accomplished in two directions. This is accomplished by means of a toy construction system where the ribs are situated at the free edges of the walls. Hereby it is obtained that the ribs serving as snap-edges are situated as far away as possible from the attachment points for the arms, whereby the flexing of said arms is as small as possible with an ensuing increase in the product longevity.

In toy construction systems of the type described herein it is convenient that the building elements can be interconnected laterally as well as axially while simultaneously ensuring that there is an increased holding force, i.e. resistance to separation in the axial direction compared to the lateral direction, since very stable constructions are hereby obtained, where forces are usually transmitted as pull forces or pressure forces but only rarely as shear forces or lateral forces. It is therefore convenient that the snap mechanism in the axial direction is asymmetrical whereby separation in the axial direction requires considerably more power than in case of interconnecting in the axial direction, but also more power than in case of separation in the lateral direction. Thus, in practice interconnecting is possible axially as well as laterally whereas separation is preferably accomplished by shearing in the lateral direction or by the interconnected elements being twisted or broken apart without ensuing damage to the elements. Finally, building elements can readily be added, removed or replaced in a construction, also in case a building element has been interconnected with a plurality of other building elements in the construction, since there is no need to displace or move the surrounding building elements in the construction in order to accomplish replacement of a building element. This makes editing of constructions very flexible.

BRIEF DESCRIPTION OF THE DRAWINGS

In the following, the invention is explained with reference to the drawings, wherein.

DETAILED DESCRIPTION OF THE PREFERRED EMBODIMENTS

Figure 1:
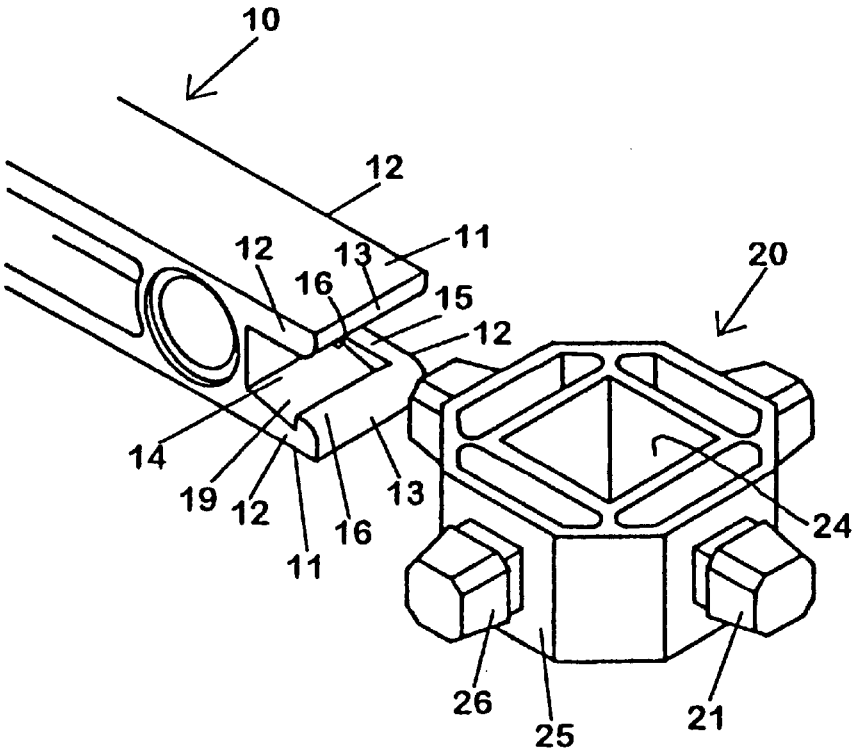
FIG. 1 is a perspective view of a building element of a first type and a building element of a second type.

FIGS. 1–9 illustrate an end portion of a building element 10 of a first type that is made of plastics. The building element 10 of the first type is elongate and has a substantially square outer configuration. In the end shown the building element 10 has a pair of protruding walls or arms 11 that are identical. Each of the walls 11 has two free, longitudinally extending edges 12 that are parallel with the longitudinal direction of the building element 10 and a free, transversally extending end edge 13 that is perpendicular to the longitudinal direction. Between the walls 11 is a space 14 with two open sides at the longitudinally extending edges 12, and an open end at the transversally extending edges 13. On those sides of each of the walls or the arms 11 that face towards the space 14, a longitudinally extending rib 15 is provided at the one of the two longitudinally extending edges 12, and a transversally extending rib 16 along the end edge 13.

FIGS. 1–9 also illustrate a building element 20 of a second type that is also made of plastics. The building element of the second type has a base portion with an outer wall of a generally octagonal shape, as will appear most clearly from FIGS. 2 and 4. Centrally in the base portion, a square, through-going opening 24 is provided that allows a building element 10 of the first type to pass through said opening. The outer wall of the building element 20 has four square faces 25, and centrally on each of the square faces 25, a coupling head 21 protrudes. The four coupling heads are identical, and each coupling head consists of a frustum of a pyramid 22 on a shank or a neck 23 with a square cross section. The frustums of a pyramid 22 are identical and have an octagonal cross section with four large faces 26 and four small faces 28.

Figure 2:
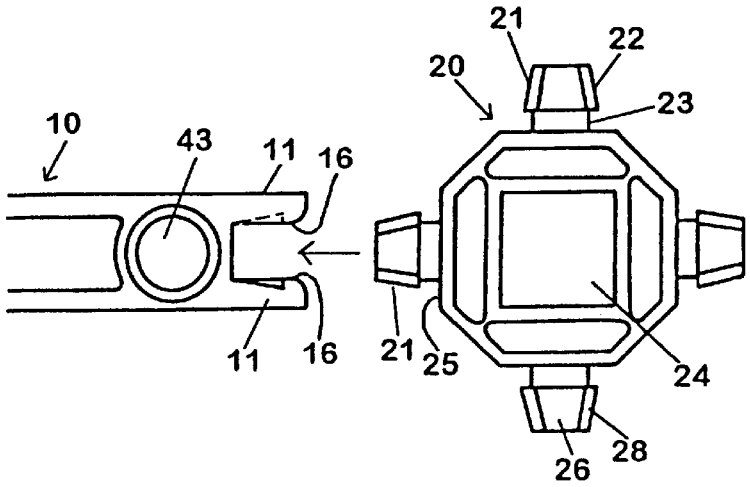
FIG. 2 illustrates the building elements shown in FIG. 1 when interconnecting in the axial direction.
Figure 3:
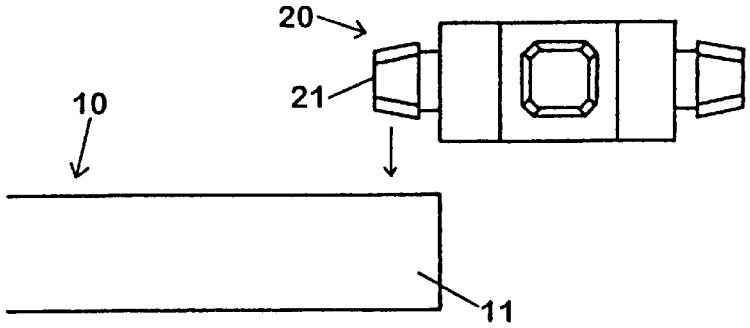
FIG. 3 illustrates the building elements shown in FIG. 1 when interconnecting in the lateral direction.

FIGS. 2–3 illustrate two different ways of combining a building element 10 of the first type with a building element 20 of the second type. In both cases a coupling head 21 is introduced onto the building element 10 between the walls 11 on the building element 10 as shown, in the directions of the arrows. The walls are resilient and may be flexed outwards.

Figure 4:
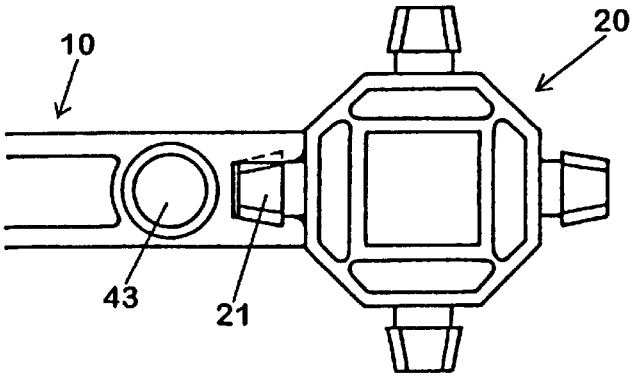
FIGS. 4 and 5 illustrate the building elements shown in FIGS. 1–3 in their assembled state and seen in two different views.
Figure 5:
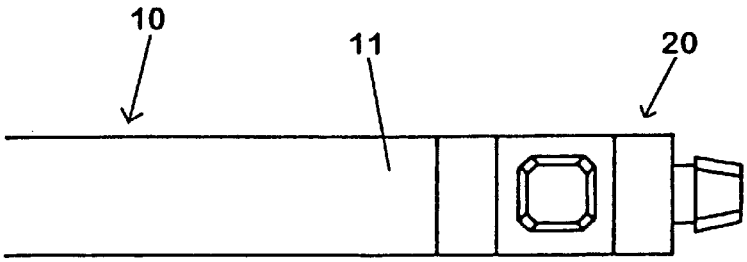

FIG. 2 illustrates the building element 10 and the building element 20 when interconnecting in an end-to-end relationship in the longitudinal direction of the building element 10. In the following, this direction is designated the axial direction. Interconnecting in the axial direction will cause two opposed large faces 26 on the coupling 21 to first come into contact with the two transversal ribs 16 at the free ends of arms 11 on the building element 10. By pressing the two building elements 10 and 20 further together in the axial direction, the large inclined faces 26 on the coupling head 21 that touch the ribs 16 on the building element 10 will force the arms 11 with the ribs apart, thereby enabling the coupling head 21 to be introduced between the ribs 16. When the entire frustum of a pyramid 22 has hereby been conveyed past the ribs 16, the elasticity of the arms 11 will cause them to move back to their starting position. Hereby a snap-fit effect will cause the ribs 16 to enter behind the frustum of a pyramid and keep the building elements 10 and 20 together in the axial direction. FIGS. 4–5 show the building elements 10 and 20 in this situation.

FIG. 3 illustrates the building element 10 and the building element 20 when interconnecting from the side or transversally to the longitudinal direction of the building element 10. In the following, this direction will be designated lateral direction. Joining in the lateral direction entails that the two small faces 28 on the coupling head 21 will first touch the longitudinally extending rib 15 on the one of the arms 11 and the longitudinal edge on the building element 10. By pressing the two building elements 10 and 20 further together in the lateral direction, the small inclined faces 28 on the coupling head 21 will, in the same manner as in case of joining in the axial direction, force the arms 11 apart, and hereby the coupling head 21 can be conveyed in between the arms 11. When the entire frustum of a pyramid 22 has thus been conveyed past the rib 15, the elasticity of the arms 11 will cause them to move back to their initial position. Hereby a snap-fit effect will cause the entire frustum of a pyramid to enter behind the ribs 15 that will keep the building elements 10 and 20 together in the lateral direction. FIGS. 4–5 show the building elements 10 and 20 in this situation.

Figure 9:
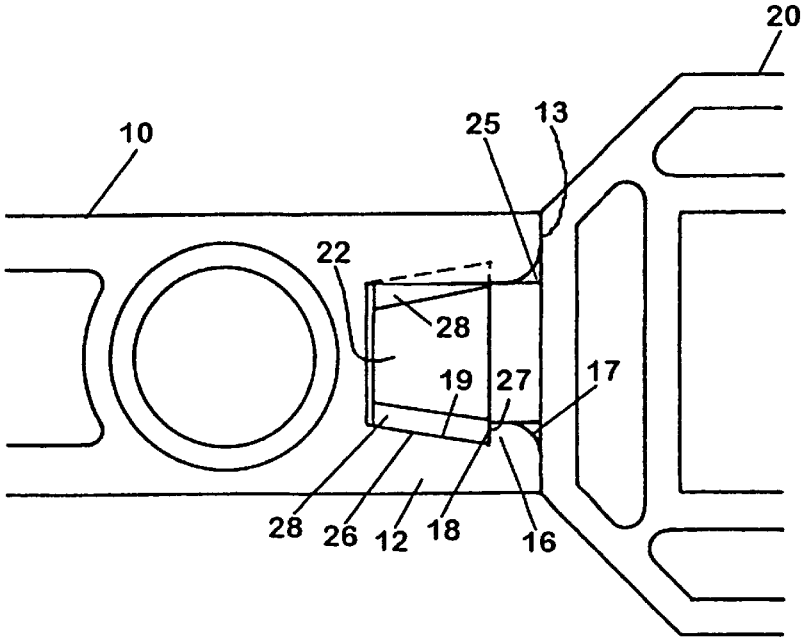
FIG. 9 is a large-scale view of the building elements shown in FIG. 4.

FIGS. 4–5 and 9 show the building elements 10 and 20 in their interconnected state. Whether the joining has been effected axially like in FIG. 2 or laterally like in FIG. 4, the same state is obtained as shown in FIGS. 4–5 and 9, where the frustum of the pyramid 22 is in contact with two longitudinally extending ribs 15 on each their wall 11, the two transversal ribs 16 also on each their wall 11, and finally also abuts on those sides 19 of the walls 11 that face towards the space 14. These sides of the walls 11 are inclined relative to the longitudinal direction of the building element 10 and has an inclination that corresponds to the inclination of the large faces 26 of the frustum of a pyramid 22, thereby establishing surface contact in their interconnected state. Finally, there is, in the interconnected state, contact between the transversal end edges 13 of the building element 10 and the square face 25 with the coupling head 21 on the building element 20. This ensures completely stable connection between the interconnected building elements 10 and 20.

FIG. 9 illustrates the interconnected building elements 10 and 20. It will appear that the transversal rib 16 at the outer edge 13 of the building element 10 has a rounded outer edge or front edge 17 and an inner edge or rear edge 18 which is substantially perpendicular to the longitudinal direction of the building element 10. It will also appear that, in addition to the inclined face 26, the frustum of a pyramid 22 of the coupling head has a rear edge that constitutes the large base area of the frustum and that is substantially perpendicular to the longitudinal direction of the building element 10. Joining in the axial direction like in FIG. 2 will mean that the inclined face 26 first touches the front edge 17 of the rib 16, and owing to the angulations of these faces relative to the longitudinal direction of the building element 10, joining of the building elements as described above is readily accomplished.

In the interconnected state, the rear edge 17 of the rib 16 is in contact with the rear edge 27 of the frustum 22 of the coupling head. These two edges or faces are, as mentioned, substantially perpendicular to the longitudinal direction, and therefore they will act against separation by direct pulling in the axial direction. The outcome is a very stable joining that may absorb considerable pull forces, and stable constructions will therefore result.

In the axial direction the snap-mechanism is thus asymmetrical whereby easy joining in the axial direction is accomplished whereas separation in the axial direction is counter-acted.

Figure 6:
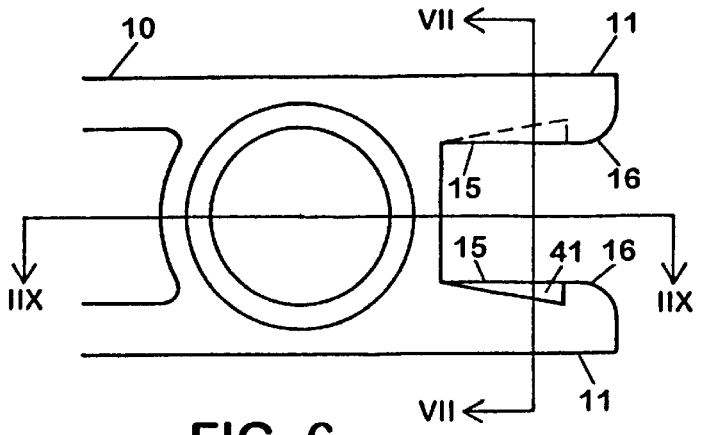
FIG. 6 illustrates an end portion of a building element of the first type.
Figure 7:
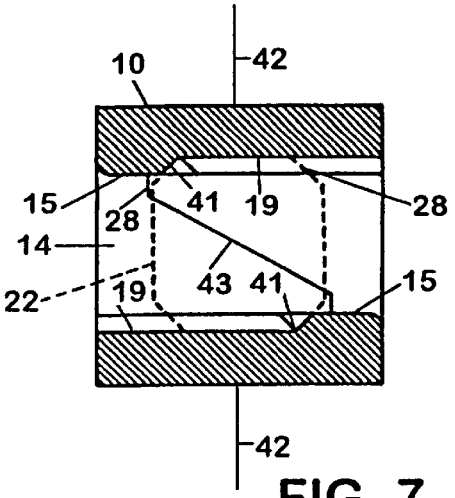
FIG. 7 is a sectional view of the building element shown in FIG. 6 along the line VII—VII.
Figure 8:
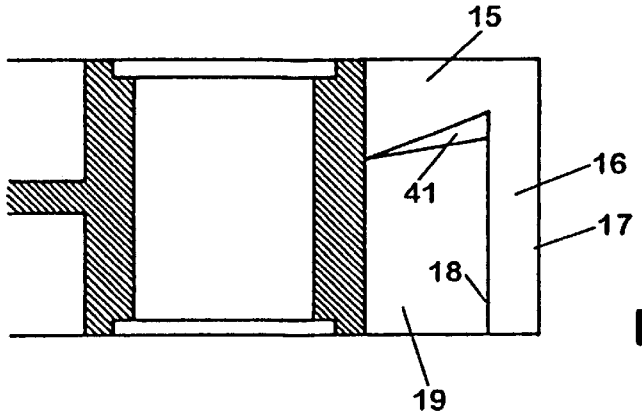
FIG. 8 is a sectional view of the building element shown in FIG. 6 along the line IXX—IXX.

FIGS. 7–8 are two different sectional views of the building element 10 shown in FIG. 6. In FIG. 7 a dotted line defines the outline of a frustum of a pyramid 22 to indicate the location of said frustum in the space 14 between the walls 11 in the assembled state. The small inclined faces 28 are in contact with the inclined inner faces 41 of the longitudinally extending ribs 15.

Separation of the combined building elements 10 and 20 can be accomplished in the lateral direction, i.e. in a direction opposite that of the assembly direction shown in FIG. 3. Hereby the small inclined faces 28 of the coupling head will press on the inclined inner faces 41 of the longitudinally extending 15 and hereby force the two walls 11 apart whereby they open and leave space for separating the building elements 10 and 20.

Separation of the combined building elements 10 and 20 can also be accomplished by tilting or capsizing the two building elements relative to each other around one of the end edges 13 on the arms 11. Hereby the coupling head will force the arms 11 apart, and the coupling head will be released from its engagement between the arms 11 and the ribs 16.

Finally, separation may also be accomplished by the building elements being rotated or twisted 45° relative to each other about the longitudinal axis. Since the width of the coupling head measured between two opposed, small, inclined faces 28 exceeds the width measured between two large, opposed faces 26, the arms 11 will also hereby be forced apart, and the coupling head may be released laterally.

FIG. 7 shows a detail which is interesting in the manufacture of the building element 10 by injection moulding in plastics. For moulding, a mould can be used that has two simple half-moulds that may be identical. Compared to the building element 10 shown in FIG. 7, one half-mould is used on the right side and one on the left side. On the outside of the building element, the two half-moulds will have their interface at the plane of symmetry 42 of the building element. Since each of the arms has only one longitudinally extending rib 15, it is natural that, in the space 14 between the walls 11, the interface 43 of the two half-moulds will extend as shown between the crests of the two ribs 15 on each their arm 11. When the moulded building element 10 is to be discharged from the mould, the two half-moulds can be separated without any particular considerations.

It will appear from FIGS. 6 and 8 that the side of the longitudinally extending rib 15 that faces towards the space 14 is substantially parallel with the outsides of the element. This, in combination with the fact that the inside 19 of the wall 11 is inclined, causes the height of the rib 15 to decrease towards the base of the arm 11 whereby the arm has, at the base of the arm 11, a constant thickness throughout its entire width. During flexing when interconnecting and disconnecting the material tension is highest at the base, and consequently the deformation is also most comprehensive at that point. The constant thickness of the arm at its base means that the arm is uniformly flexed in its entire width.

Figure 1A:
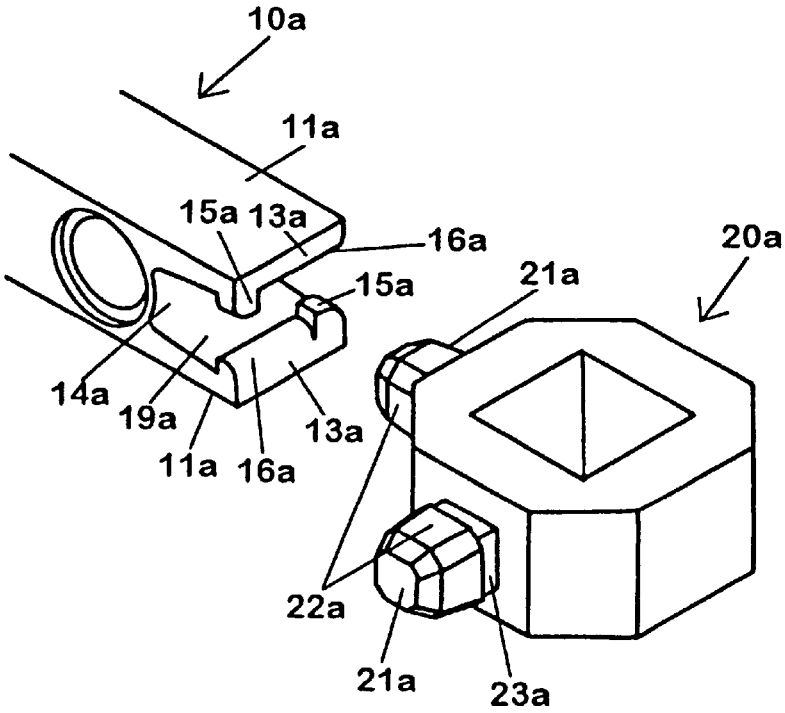
FIG. 1*a* illustrates alternative embodiments of building elements of the first type and the second type.

FIG. 1*a* shows a building element 10*a* of the first type and a building element 20*a* of the second type that distinguish themselves from the building elements 10 and 20, in accordance with the following.

Like the building element 10, the building element 10*a* has two protruding arms or walls 11*a* that are identical and define a space 14*a* between the walls. On those sides of each of the walls or arms 11*a* that face towards the space 14*a*, a transversally extending rib 16*a* is provided which has the same shape and function as the ribs 16 on the arms 11 on the building element 10. The building element 10*a* does not have any longitudinally extending ribs on the arms 11*a*, but instead the one end of each of the ribs 16*a* is provided with a tenon or a tooth which has a rounded side or shoulder towards the open side of the space 14*a*, and wherein that side of the tenon that faces away from the open side of the space is substantially perpendicular to the relevant arm 11*a* and thus substantially parallel with the open side.

Like the building element 20, the building element 20*a* has protruding coupling heads 21*a* that each consists of a frustum of a pyramid 22*a* on a shank or a neck 23*a*. Here the frustums 22*a* have an inclined or rounded edge at the free end of the coupling head.

Interconnecting in the axial direction and in the lateral direction is accomplished as described above in connection with the building elements 10 and 20, and the transversal rib 16*a* keeps the building elements 10*a* and 20*a* together in the axial direction. Contrary to the building elements 10 and 20, the building elements 10*a* and 20*a* are kept together by means of the tenons 15*a* that engages with each their one of two opposed faces of the shank or the neck 23*a*. Compared with the rib 15 on the building element 10, the tenon or tooth 15*a* only has a very short expanse in the longitudinal direction of the arm.

Substantially, the space 14*a* between the walls 11 is delimited by the insides 19*a* of the walls 11*a*. The insides 19*a* are not parallel but inclined such that the inclined faces of the frustum 22*a* of the coupling head are, in the interconnected state, in contact with the insides 19*a*. Hereby the building elements 10*a* and 20*a* are secured relative to each other. Separation of the building elements 10*a* and 20*a* may be effected in a manner similar to the one described above in connection with the building elements 10 and 20.

The arms 11*a* have parallel outsides and inclined insides 19*a* whereby the arms 11*a* obtain a wedge-shaped longitudinal section. Assembly and separation will cause the arms 11*a* to be influenced only by forces on the ribs 16*a* and/or the tenons 15*a*, that are all situated at the free ends of the arms 11*a*. Owing to the wedge-like configuration of the arms, their deformation will be distributed over their length and not be concentrated at their base. Hereby the risk of the arms breaking during assembly and separation is reduced.

I claim:

1. A toy construction system, comprising:

building elements of a first type having a pair of opposed walls that define a space between said opposed walls, wherein the space has, at free edges of the opposed walls, an open end facing in an axial direction, and two opposed open sides each facing in a lateral direction, and wherein those sides of the walls that face towards the space are provided with means for providing a snap-fit protruding into the space; and building elements of a second type having a coupling head that may, by snap-fit with the protruding snap-fit means, be received and releasably secured in the space between the walls on a building element of the first type;

wherein at least one of the walls provides said protruding snap-fit means at the open end allowing a snap-fit in the axial direction, and wherein each of the opposed walls provides said protruding snap-fit means at an open side allowing a snap-fit in the lateral direction.

2. The toy construction system according to claim 1, wherein at the open sides and open end, the protruding snap-fit means are in the form of ribs having leading surfaces with angles that form a funnel-shaped opening, and the coupling head has a tapering shape that matches the funnel-shaped opening.

3. The toy construction system according to claim 2, wherein, at the open end, the ribs have trailing surfaces that face away from the open end and that have a steeper angulation relative to the axial direction than the funnel-shaped opening, and the coupling head has surfaces for abutment on the trailing surfaces of the ribs and having a corresponding angulation.

4. The toy construction system according to claim 3, wherein the trailing surfaces of the ribs and the corresponding abutment surfaces of the coupling head are substantially perpendicular to the axial direction.

5. The toy construction system according to claim 1, wherein, at their free ends, the walls have a rib with a tenon at the one end of the rib.

* * * * *